US007095217B1

(12) United States Patent
Niculae et al.

(10) Patent No.: US 7,095,217 B1
(45) Date of Patent: Aug. 22, 2006

(54) METHOD CIRCUITRY AND ELECTRONIC DEVICE FOR CONTROLLING A VARIABLE OUTPUT DC POWER SOURCE

(75) Inventors: Marian Niculae, San Jose, CA (US); Constantin Bucur, Santa Clara, CA (US)

(73) Assignee: O2Micro International Limited, Grand Cayman (KY)

( * ) Notice: Subject to any disclaimer, the term of this patent is extended or adjusted under 35 U.S.C. 154(b) by 0 days.

(21) Appl. No.: 11/094,983

(22) Filed: Mar. 31, 2005

(51) Int. Cl.
*G05F 1/40* (2006.01)

(52) U.S. Cl. ..... 323/274

(58) Field of Classification Search ..... 323/274, 323/275, 280
See application file for complete search history.

(56) References Cited

U.S. PATENT DOCUMENTS

| | | | | |
|---|---|---|---|---|
| 4,621,313 A | | 11/1986 | Kiteley | 363/49 |
| 4,814,687 A | * | 3/1989 | Walker | 323/275 |
| 5,623,197 A | | 4/1997 | Roseman et al. | 320/134 |
| 5,698,964 A | | 12/1997 | Kates et al. | 320/164 |
| 5,723,970 A | | 3/1998 | Bell | 320/140 |
| 5,912,549 A | | 6/1999 | Farrington et al. | 323/207 |
| 5,920,475 A | | 7/1999 | Boylan et al. | 363/127 |
| 6,184,660 B1 | | 2/2001 | Hatular | 320/141 |
| 6,351,110 B1 | | 2/2002 | Pappalardo et al. | 323/285 |
| 6,369,561 B1 | | 4/2002 | Pappalardo et al. | 323/285 |
| 6,396,716 B1 | | 5/2002 | Liu et al. | 363/17 |
| 6,498,461 B1 | | 12/2002 | Bucur | 320/145 |
| 6,611,129 B1 | | 8/2003 | Bucur | 320/145 |

OTHER PUBLICATIONS

U.S. Appl. No. 10/757,871, filed Jan. 15, 2004, specification including claims and drawings (47 pages).

* cited by examiner

*Primary Examiner*—Shawn Riley
(74) *Attorney, Agent, or Firm*—Grossman, Tucker, Perreault & Pfleger, PLLC

(57) ABSTRACT

Power control circuitry and method for controlling a variable output DC power source. The power control circuitry may comprise a first comparator to compare a signal representative of an output current level of the variable output DC power source with a threshold level and provide a first output signal in response to the comparison. The power control circuitry may further comprise threshold input circuitry to provide the threshold level to the first comparator, the threshold level being a fixed threshold level if an output voltage of the variable output DC power source is less than or equal to a first fixed voltage level, the threshold level being a variable threshold level if the output voltage is greater than the first fixed voltage level.

19 Claims, 4 Drawing Sheets

METHOD CIRCUITRY AND ELECTRONIC DEVICE FOR CONTROLLING A VARIABLE OUTPUT DC POWER SOURCE

FIELD

This disclosure relates to direct current (DC) power sources and in particular to variable output DC power sources.

BACKGROUND

A variety of electronic devices such as cell phones, laptop computers, and personal digital assistants to name only a few, may be powered by one or more variable output DC power sources. A variable output DC power source may accept an unregulated input voltage and provide a variable output DC voltage and output current to a load of the electronic device. The unregulated input voltage may be an alternating current (AC) or DC input voltage.

Like other power supply sources, the variable output DC power source may be capable of providing a maximum output power to the load. At any time, the actual output power can be expressed as the product of the output voltage and output current. The instantaneous values of the output voltage/current of the variable output DC power source may be controlled by one or more control signals. These control signals may be provided according to a power management algorithm and may be the result of a set of sensing signal processing performed by power control circuitry. Other limitations may be imposed on the instantaneous output voltage/current of the variable output DC power source, but for clarity and simplicity, analysis herein is directed to the output power limiting features of the power control circuitry. Hence, if other limitations are not imposed, as the output voltage is reduced the output current can be increased as long as the product of the output voltage and output current is less than the maximum output power. Similarly, as the output current is reduced the output voltage can be increased as long as the product of the output current and output voltage is less than the maximum output power.

However, since power control circuits are relatively complicated and expensive, a conventional power control circuit limits the output current to a fixed maximum current level and limits the output voltage to a fixed maximum voltage level. The fixed maximum current and voltage levels are designed so that the product of each is at most equal to the maximum output power. Although a simple approach, this conventional power control circuit significantly reduces the safe operation region of the variable output DC power source.

BRIEF DESCRIPTION OF THE DRAWINGS

Features and advantages of embodiments of the claimed subject matter will become apparent as the following Detailed Description proceeds, and upon reference to the Drawings, where like numerals depict like parts, and in which:

Although the following Detailed Description will proceed with reference being made to illustrative embodiments, many alternatives, modifications, and variations thereof will be apparent to those skilled in the art. Accordingly, it is intended that the claimed subject matter be viewed broadly.

DETAILED DESCRIPTION

Figure 1:
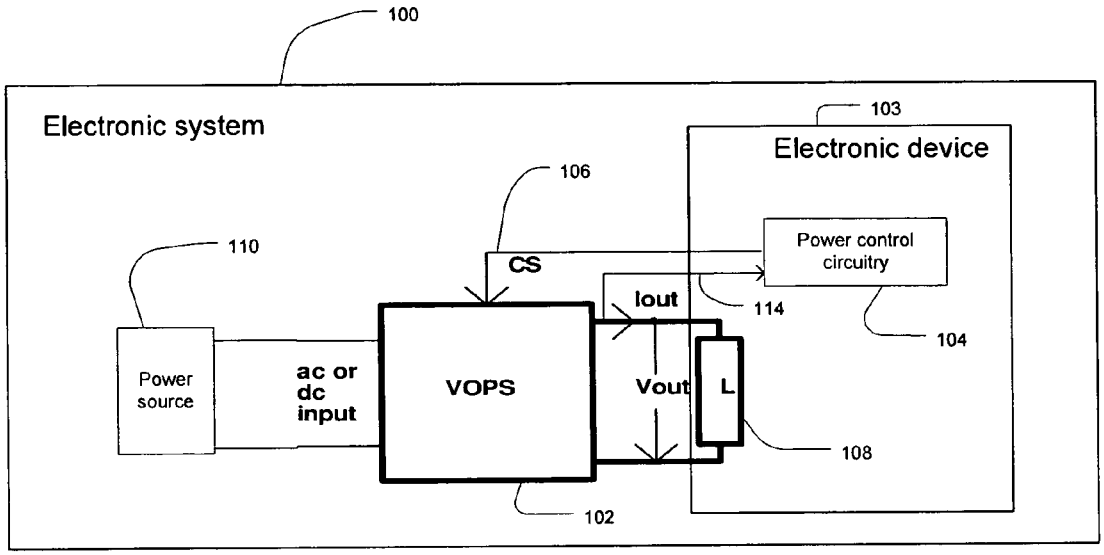
FIG. 1 is a block diagram of an electronic system having a variable output DC power source.

FIG. 1 illustrates an electronic system 100. The electronic system may include a power source 110, a variable output DC power source (VOPS) 102, and an electronic device 103. The electronic device 103 may include a load 108 and power control circuitry 104. The power source 110 may be any variety of power sources capable of supplying an AC or DC input voltage to the VOPS 102. The VOPS 102 may accept input power from the power source 110 and provide power to the load 108. The electronic device 103 may be any variety of electronic devices, including, but not limited to, a server computer, a desk top computer, a laptop computer, a cell phone, a personal digital assistant, digital camera, etc. The load 108 may represent the load of the entire electronic device 103 or a part of the electronic device 103. The load 108 may also represent a stand alone load which is not part of the electronic device 103. FIG. 1 illustrates only one of many possible topologies or systems since, for example, in other instances the VOPS 102 may be part of the electronic device 103, or the power control circuitry 104 may be part of the VOPS 102, etc. In one example, the power source 110 may be a common 120 volt/60 Hertz AC power line, the VOPS 102 may be a variable output ACDC adapter, and the electronic device 103 may be a laptop computer and the load 108 may represent the entire load of the laptop computer.

The variable output DC power source 102 may accept the unregulated input voltage and provide a variable output DC voltage (Vout) and output current (Iout) to the load 108. The variable output DC power source 102 may provide varying Vout and Iout levels in response to one or more control signals (CS) from the power control circuitry 104. As used herein, "circuitry" may comprise, for example, singly or in any combination, hardwired circuitry, programmable circuitry, state machine circuitry, and/or firmware that stores instructions executed by programmable circuitry. The power control circuitry 104 may accept one or more input signals via path 114. The input signals may be representative of Iout and/or Vout provided by the variable output DC power source 102 to the load 108. The power control circuitry 104 may provide one or more output control signals (CS) via path 106 to the VOPS 102.

Figure 2:
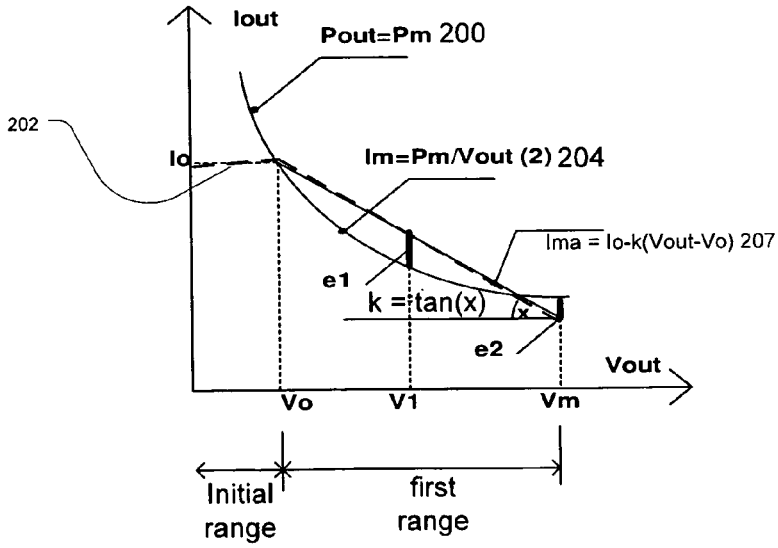
FIG. 2 illustrates plots of both ideal and approximated output current versus output voltage of the variable output DC power source of FIG. 1 for maximum output power.

FIG. 2 illustrates a plot 200 of the maximum output power (Pm) of the variable output DC power source 102 of FIG. 1 where the y-axis represents output current (Iout) and the x-axis represents output voltage (Vout) of the variable output DC power source 102. Since the output power is the product of Vout and Iout, the plot 200 is the hyperbolic curve (Iout)(Vout)=Pm, where the permissible output current hyperbolically decreases with increasing output voltage levels. A particular point of a fixed current level (Io) and fixed voltage level (Vo) on the plot 200 is also illustrated. Conventional power control circuitry may limit the output voltage to Vo and the output current to Io thus limiting the safe operating region of the variable output DC power source.

The power control circuitry 104 consistent with an embodiment may monitor Iout and Vout and compare a signal representative of Iout to a particular threshold value depending on the value of Vout. The threshold value may be a fixed threshold value for an initial range of voltage levels, e.g., from about 0 volts to Vo, and the threshold value may be a variable threshold value for another range of voltage levels, e.g., from Vo to Vm. If the monitored output current is equal to or greater than the appropriate threshold level for an associated voltage level, the power control circuitry 104 may provide a control signal to the variable output DC power source 102. In response, the variable output DC power source 102 may drive the output current to the appropriate maximum current level for an associated output voltage.

Ideally, the maximum output current Im of the variable output DC power source 102 may be as detailed in equations (1) and (2):

$$Im=Io, \text{ when } Vout \leqq Vo \tag{1}$$

$$Im=Pm/Vout, \text{ when } Vo<Vout \leqq Vm \tag{2}$$

where Io is a fixed current level and Vo is a fixed voltage level of a conventional system such that Vo×Io=Pm, where Vout is the output voltage level of the variable output DC power source 102, and Pm is the maximum output power of the variable output DC power source 102. Plot 202 represents the plot of Im values over the initial voltage range specified in equation (1) and plot 204 represents the plot of Im values over the first voltage range specified in equation (2). However, circuitry to limit the output current of the variable output DC power source 102 to the variable maximum output current Im as expressed by equation (2) may be complicated and expensive.

Accordingly, a method and circuitry consistent with an embodiment may establish another plurality of output current levels Ima in response to the current levels Im defined by equation (2). The plurality of output current levels Ima may approximate the plurality of output current levels Im as defined by equation (2) and may be given by equation (3):

$$Ima=Io-k(Vout-Vo), \text{ for } Vo<Vout \leqq Vm \tag{3}$$

where k is a constant representing the slope of the line 207 defined by equation (3). The constant k represents conductance and may be expressed in units of siemens. The constant k may also be expressed as the tangent(x) where the angle x is detailed in FIG. 2.

A plot 207 defined by equation (3) for a selected k that provides a linear approximation for the plot 204 over the first voltage range, Vo<Vout≦Vm is illustrated in FIG. 2. The difference between plots 207 and 204 has been exaggerated in FIG. 2 for clarity of illustration. As detailed herein, the difference between plots 207 and 204 can be minimized to yield approximation errors of 1.0% or less. Error e1 represents the maximum positive error between one of the output current levels defined by plot 204 and one of the output current levels defined by plot 207 which may occur at voltage V1. Error e2 represents the maximum corresponding negative error over the same voltage range which occurs at the voltage Vm. Both errors e1 and e2 are dependent on the value of k and may be evaluated by analytical mathematical means. Since errors e1 and e2 are dependent on the value of k, k may be selected to result in errors e1 and e2 such that the absolute value of each error e1 and e2 divided by the respective ideal current limit at associated voltage levels V1 and Vm are equal as detailed in equation (4).

$$\frac{|e1|}{\frac{P_m}{V_1}} = \frac{|e2|}{\frac{P_m}{Vm}} \tag{4}$$

Choosing k to result in errors e1 and e2 that satisfy equation (4) is one method of achieving a minimum overall relative approximation error for the linear plot 207 compared to the plot 204 over the same voltage range. Other approaches based on different conditions imposed to e1, e2, or both may be chosen to result in different values of k.

In one example, the maximum output power Pm of the variable output DC power source 102 may be 64 watts. The voltage Vo may be 12 volts, the current Io may be 5.33 amps, and the maximum voltage Vm may be 16 volts. In this example, the value of k may be chosen to be 0.348 siemens to result in an error e2 of only 0.04A compared to ideal current of 4.0A or only a 1.0% error at this voltage level.

Figure 3:
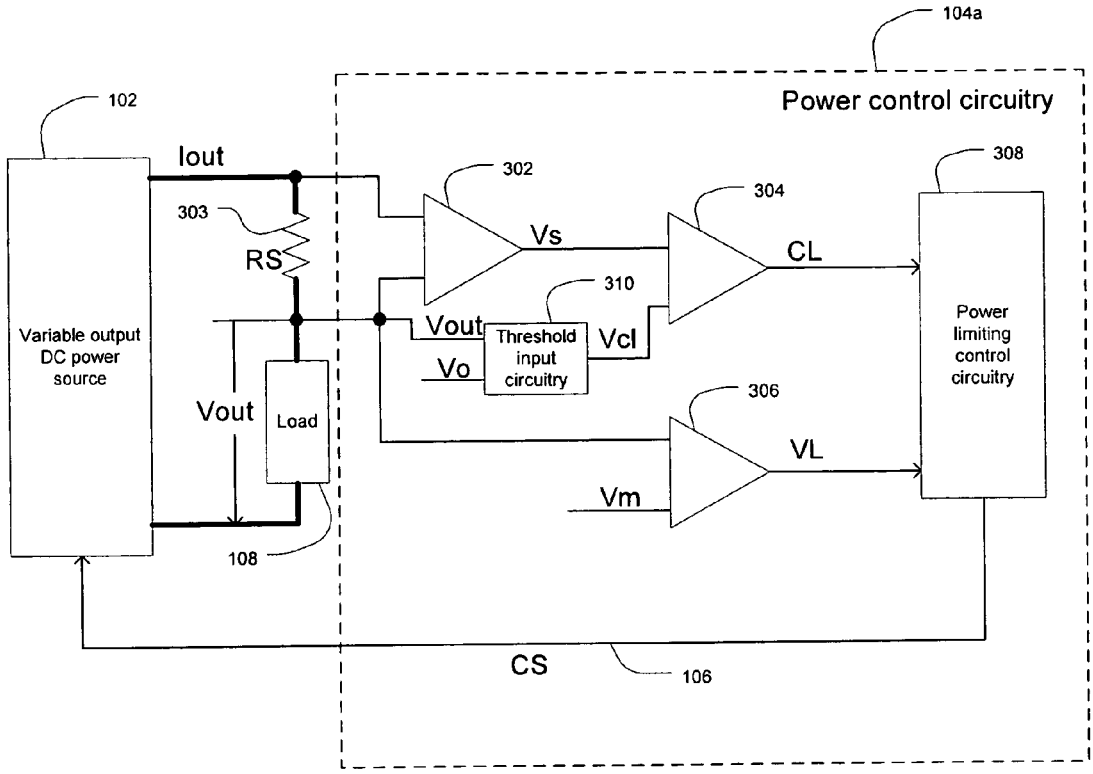
FIG. 3 is a diagram of an embodiment of the power control circuitry of FIG. 1 illustrating the circuitry performing a power limiting function.

FIG. 3 illustrates an embodiment 104*a* of the power limiting part of the power control circuitry 104 of FIG. 1. The power control circuitry 104*a* may include a current sense amplifier 302, a current limit comparator 304, a voltage limit comparator 306, threshold input circuitry 410, and power limiting control circuitry 308. A sense resistor 303 having a resistance level RS may be utilized to sense the output current Iout of the variable output DC power source 102. Other types of current sensors may also be utilized. The value of the voltage drop across the sense resistor 303 may provide a signal representative of the output current Iout. The current sense amplifier 302 may then amplify this signal and provide an output voltage signal Vs to the comparator 304.

The output voltage signal Vs from the sense amplifier 302 may be defined by equation (5):

$$Vs=RS\times A\times Iout, \tag{5}$$

where RS is the resistance value of the sense resistor 303, A is the gain of the sense amplifier 302 and Iout is the output current of the variable output DC power source 102. The comparator 304 may compare the signal (Vs) representative of the output current (Iout) to a threshold level. The threshold level (Vc1) may be a fixed threshold (Vc1=Vc1*o*) or a variable threshold (Vc1=Vc1) depending on the value of Vout. The fixed threshold may be provided by the threshold input circuitry 310 to the comparator 304 if the output voltage Vout is less than or equal to the fixed voltage level Vo during the initial voltage range as illustrated in FIG. 2. The variable threshold may be provided by the threshold circuitry 310 to the comparator 304 if the output voltage Vout is Vo<Vout≦Vm during the first voltage range as illustrated in FIG. 2.

The fixed threshold (Vc1*o*) may be defined by equation (6):

$$Vc1o=RS\times A\times Io \tag{6}$$

where RS is the resistance value of the sense resistor 303, A is the gain of the sense amplifier 302 and Io is the selected fixed maximum current level over the initial range of output voltages less than or equal to Vo. Whenever the actual output current Iout equals Io, the voltage level Vs of equation (5) becomes equal to the voltage level Vc1*o* of equation (6) and the comparator 304 provide an output voltage signal (CL) to the power limiting control circuitry 308 representative of this condition. In response, the power limiting control circuitry 308 may provide a control signal via path 106 to the variable output DC power source 102 to instruct the variable output DC power source 102 to drive its output current to Io.

The comparator 306 may receive a signal representative of the output voltage Vout. The comparator 306 may also receive a signal representative of a maximum voltage level Vm. The comparator 306 may compare such signals and output a voltage signal (VL) to the power limiting control circuitry 308 in response to this comparison. If the output voltage level is equal to or greater than Vm, the output voltage signal (VL) from the comparator 306 may be representative of this condition. In response, the power limiting control circuitry 308 may provide a control signal via path 106 to the variable output DC power source 102 to instruct the variable output DC power source 102 to drive its output voltage to Vm.

Figure 4:
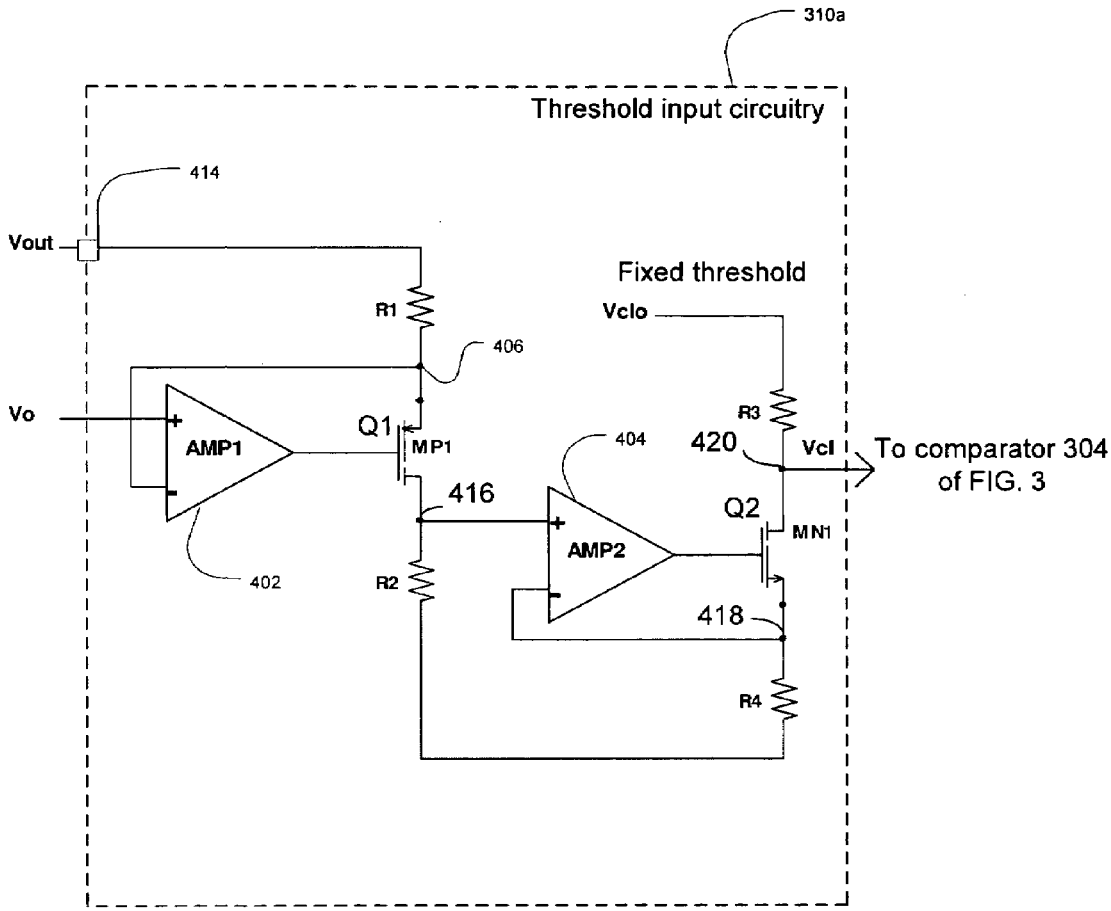
FIG. 4 is circuit diagram of one embodiment of the threshold input circuitry of FIG. 3.

FIG. 4 illustrates an embodiment 310*a* of the threshold input circuitry 310 of FIG. 3 that may provide the fixed threshold (Vc1=Vc1*o*) to the comparator 304 if the output voltage Vout is less than or equal to Vo and may provide the variable threshold (Vc1=Vc1) to the comparator 304 if the output voltage Vout is greater than Vo and less than Vm. The variable current limit may be as detailed in equation (3) or Ima=Io−k×(Vout−Vo). The variable threshold Vc1 may then be defined by equation (7):

$$Vc1=RS\times A\times Ima, \tag{7}$$

where Vc1 is the variable voltage threshold input to comparator 304, RS is the resistance value of sense resistor 303, A is the gain of the sense amplifier 302, and Ima is the maximum output current of the variable output DC power source 102 for a particular output voltage level in the first range of voltages where Vo<Vout≦Vm. Given Ima as detailed in equation (3), equation (7) can be rewritten as detailed in equation (8).

$$Vc1=RS\times A\times[Io-k\times(Vout-Vo)] \tag{8}$$

Since RS×A×Io may be expressed as Vc1*o* as detailed in equation (6), equation (8) may further be simplified to equation (9).

$$Vc1=Vc1o-k1(Vout-Vo), \text{ where k1 is a constant equal to RS×A×k.} \tag{9}$$

The threshold input circuitry 310*a* may include operational amplifiers 402, 404, transistors Q1, Q2, and resistors R1, R2, R3, and R4. Transistors Q1 and Q2 may be any variety of transistors. In one embodiment, transistor Q1 may be a p-type metal oxide semiconductor field effect transistor (MOSFET) or PMOS MP1. Transistor Q2 may be an n-type MOSFET or NMOS MN1. The first resistor R1 may be disposed between a terminal 414 accepting the output voltage Vout and a source terminal of the transistor MP1. Node 406 may be connected to the inverting input of the operation amplifier 402. The noninverting input of the operational amplifier 402 may be connected to the input terminal accepting the fixed voltage Vo. The transistor MP1 may have its control or gate terminal coupled to the output of the operational amplifier 402.

The second resistor R2 may be connected between the drain of transistor MP1, the node 416, and ground. The transistor MN1 may have its control or gate terminal coupled to the output of the operational amplifier 404 to accept an output signal from the operational amplifier 404. A third resistor R3 may be coupled to an output node 420 and a terminal providing the fixed threshold level Vc1*o*. The third resistor R3 may also be coupled to the drain terminal of transistor MN1. The output node 420 may provide the output threshold level signal Vc1 from the threshold input circuitry 310*a*. The fourth transistor R4 may be connected between the source terminal of transistor MN1, the node 418, and ground. The inverting input terminal of the operational amplifier 404 may be coupled to node 418, while its noninverting input may be coupled to node 416.

In operation, operational amplifier 402 may drive the gate of MP1 to conduct a current in order to permanently maintain the voltage level on its inverting input (node 406) at the same level with its noniverting input, the fixed voltage Vo. This is possible whenever the output voltage Vout is higher than Vo, the resulting current through both resistors R1 and R2 being I1=(Vout−Vo)/R1. When Vout<Vo the current through transistor MP1 cannot be further reduced, the gate of transistor MP1 is driven to the maximum available voltage, transistor MP1 is OFF and the current through resistors R1 and R2 becomes zero. Consequently the voltage on the resistor R2, i.e. between node 416 and the ground, is Vr2=0 when Vout<Vo and Vr2=R2 I1=(R2/R1)×(Vout−Vo) when Vout>Vo. For reasons known to those skilled in the art through a feedback mechanism Vr2 will be repeated on the resistor R4, namely between the node 418 and the ground, generating the current I2=Vr2/R4 when Vout>Vo and I2=0 when Vout<Vo. Since the same current I2 flows through the resistor R3 it becomes evident that the output threshold voltage Vc1 on the node 420 may be expressed as in equation (10) for Vout>Vo and is constant Vc1=Vc1*o* when the output voltage of the DC source Vout is less than Vo.

$$Vcl = Vclo - \frac{R3}{R4}\cdot\frac{R2}{R1}(Vout - Vo) \tag{10}$$

In equation (10), Vc1 is the variable threshold level provided at the output node 420, Vc1*o* is the fixed threshold level, R1, R2, R3, and R4 are the resistance values of resistors R1, R2, R3, and R4, Vout is the output voltage, and Vo is the fixed voltage level defining the boundary between the initial and first range of output voltages as illustrated in FIG. 2.

By comparing equation (9) and (10), it becomes evident that the value of the resistors R1, R2, R3, and R4 could be chosen such that equation (11) is true.

$$\frac{R3}{R4}\cdot\frac{R2}{R1} = k1 = RS\cdot A\cdot k \tag{11}$$

Figure 5:
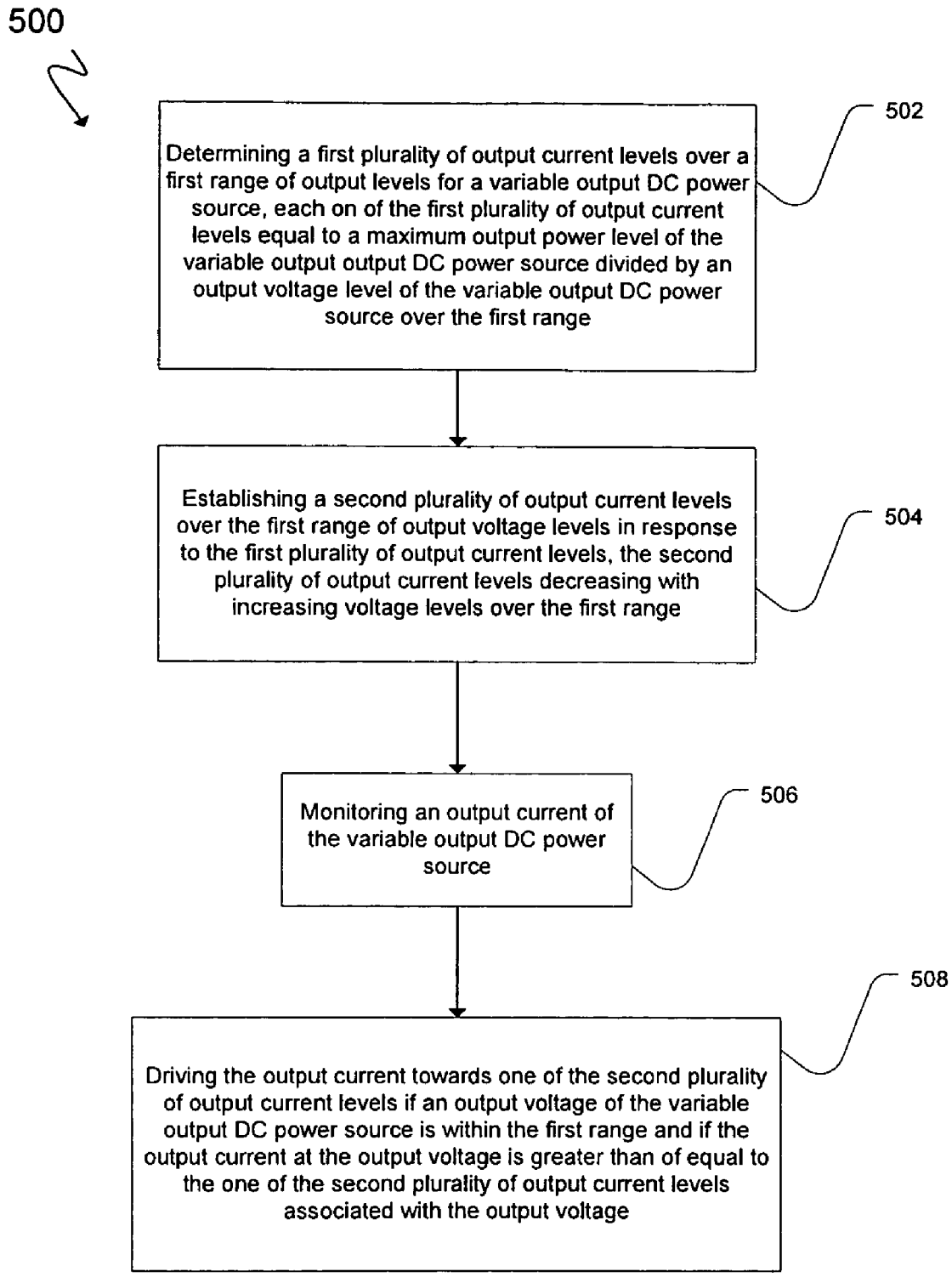
FIG. 5 is a flow chart illustrating operations that may be performed according to an embodiment.

FIG. 5 illustrates a flow chart 500 of operations consistent with an embodiment. Operation 502 may include determining a first plurality of output current levels over a first range of output voltage levels for a variable output DC power source, each one of the first plurality of output current levels equal to a maximum output power level of the variable output DC power source divided by an output voltage level of the variable DC power source over the first range. For instance, in one embodiment the first plurality of output current levels (Im) may be those defined by plot 204 in FIG. 2 over the range of output voltage levels where Vo<Vout≦Vm.

Operation 504 may include establishing a second plurality of output current levels over the first range of output voltage levels in response to the first plurality of output current levels, the second plurality of output current levels decreasing with increasing voltage levels over the first range. For instance, in one embodiment the second plurality of output current levels (Ima) may be those defined by plot 207 in FIG. 2. Operation 506 may include monitoring an output current of the variable output DC power source. Finally, operation 508 may include driving the output current towards one of the second plurality of output current levels, e.g., Ima levels, if an output voltage of the variable output DC power source is within the first range and if the output current at the output voltage is greater than or equal to the one of the second plurality of output current levels (Ima) associated with the output voltage.

In summary, there is also provided power control circuitry for controlling a variable output DC power source. The power control circuitry may comprise a first comparator to compare a signal representative of an output current level of the variable output DC power source with a threshold level and provide a first output signal in response to the comparison. The power control circuitry may further comprise threshold input circuitry to provide the threshold level to the first comparator, the threshold level being a fixed threshold level if an output voltage of the variable output DC power source is less than or equal to a first fixed voltage level, the threshold level being a variable threshold level if the output voltage is greater than the first fixed voltage level. The power control circuitry may further comprise power limiting control circuitry to provide a control signal to the variable output DC power source in response to the first output signal from the first comparator.

In one embodiment the variable threshold may be representative of a second plurality of output current levels (Ima) of the variable output DC power source over the first range, the second plurality of output current levels (Ima) may approximate a first plurality of output current levels (Im) where each one of the first plurality of output current levels equals a maximum output power level of the variable output DC power source divided by an output voltage of the variable output DC power source over the first range. The first plurality of output current levels (Im) hyperbolically decreases with increasing voltage levels over the first range and the second plurality of output current levels (Ima) may linearly decrease with increasing voltage levels over the first range.

There is also provided an electronic system. The system may comprise a variable output DC power source to provide power to a load, and power control circuitry to provide a control signal to the variable output DC power source. The variable output DC power source may be responsive to the control signal to adjust the output power level of the DC power source. The power control circuitry may comprise a first comparator to compare a signal representative of an output current level of the variable output DC power source with a threshold level and provide a first output signal in response to the comparison. The power control circuitry may further comprise threshold input circuitry to provide the threshold level to the first comparator, the threshold level being a fixed threshold level if an output voltage of the variable output DC power source is less than or equal to a first fixed voltage level, the threshold level being a variable threshold level if the output voltage is greater than the first fixed voltage level. The power control circuitry may further comprise power limiting control circuitry to provide a control signal to the variable output DC power source in response to the first output signal from the first comparator.

Advantageously, in these embodiments the output voltage of the variable output DC power source can be extended to operate in the $Vo<Vout\leqq Vm$ range. By approximating the hyperbolically decreasing plot of output current values, e.g., plot 204, simplified power control circuitry can be more readily developed compared to other circuitry that may attempt to limit the output current to the hyperbolic plot. A linear plot of output current levels, e.g., plot 207, may be developed to approximate the hyperbolically decreasing plot. Errors between the linear plot and hyperbolic plot can be minimized by mathematical and analytical means.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. A method comprising:

determining a first plurality of output current levels over a first range of output voltage levels for a variable output DC power source, each one of said first plurality of output current levels equal to a maximum output power level of said variable output DC power source divided by an output voltage level of said variable output DC power source over said first range;

establishing a second plurality of output current levels over said first range of output voltage levels in response to said first plurality of output current levels, said second plurality of output current levels decreasing with increasing voltage levels over said first range;

monitoring an output current of said variable output DC power source; and driving said output current towards one of said second plurality of output current levels if an output voltage of said variable output DC power source is within said first range and if said output current at said output voltage is greater than or equal to said one of said second plurality of output current levels associated with said output voltage.

2. The method of claim 1, further comprising:

defining an initial range of output voltage levels for said variable output DC power source, said initial range from about zero volts to a first fixed voltage level, said first range of output voltage levels from said first fixed voltage level to a second fixed voltage level, said second fixed voltage level greater than said first fixed voltage level;

establishing a fixed current level over said initial range; and driving said output current towards said fixed current level if said output voltage of said variable output DC power source is within said initial range and if said output current is greater than or equal to said fixed current level.

3. The method of claim 2, wherein said second plurality of output current levels are given by an equation:

$$Ima=Io-k(Vout-Vo)$$

wherein Ima is one of said second plurality of output current levels, wherein Io is said fixed current level, wherein k represents a slope of a line defined by said equation, wherein Vout is said output voltage of said variable output DC power source over said first range, and wherein Vo is said first fixed voltage level.

4. The method of claim 1, wherein said second plurality of output current levels linearly decreases with increasing voltage levels over said first range of output voltage levels.

5. The method of claim 1, wherein said first plurality of output current levels hyperbolically decreases with increasing voltage levels over said first range and wherein said second plurality of output current levels linearly decreases with increasing voltage levels over said first range, and wherein said method further comprises establishing said second plurality of output current levels to approximate said first plurality of output current levels.

6. Power control circuitry for controlling a variable output DC power source, said power control circuitry comprising:

a first comparator to compare a signal representative of an output current level of said variable output DC power source with a threshold level and provide a first output signal in response to said comparison;

threshold input circuitry to provide said threshold level to said first comparator, said threshold level being a fixed threshold level over an initial range of output voltage values where an output voltage of said variable output DC power source is less than or equal to a first fixed voltage level, said threshold level being a variable threshold level over a first range of output voltage values where said output voltage is greater than said first fixed voltage level; and power limiting control circuitry to provide a control signal to said variable output DC power source in response to said first output signal from said first comparator.

7. The power control circuitry of claim 6, wherein said variable threshold is representative of a second plurality of output current levels of said variable output DC power source over said first range, said second plurality of output current levels approximates a first plurality of output current levels where each one of said first plurality of output current levels equals a maximum output power level of said variable output DC power source divided by an output voltage of said variable output DC power source over said first range.

8. The power control circuitry of claim 7, wherein said first plurality of output current levels hyperbolically decreases with increasing voltage levels over said first range and wherein said second plurality of output current levels linearly decreases with increasing voltage levels over said first range.

9. The power control circuitry of claim 6, wherein said threshold input circuitry comprises:

a first transistor controlled by an output of a first operational amplifier, said first transistor turning OFF is said output voltage is less than said first fixed voltage level, said threshold level being said fixed threshold level if said first transistor is OFF.

10. The power control circuitry of claim 9, said first transistor turning ON if said output voltage is greater than said first fixed voltage level, said threshold level being said variable threshold level if said first transistor is ON.

11. The power control circuitry of claim 10, wherein said variable threshold is equal to said fixed threshold less an amount dependent on a difference by which said output voltage exceeds said first fixed voltage level.

12. The power control circuitry of claim 11, wherein said threshold input circuitry further comprises:

a first resistor disposed between a terminal accepting said output voltage and a terminal of said first transistor;

a second resistor coupled to another terminal of said first transistor;

a second operational amplifier having one input coupled to said another terminal of said first transistor;

a second transistor having a control terminal to accept a signal from said second operational amplifier;

a third resistor disposed between a terminal accepting said fixed threshold level and a terminal of said second transistor, an output node coupled between said third resistor and said terminal of said second transistor;

a fourth resistor coupled to another terminal of said second transistor, wherein said variable threshold level is given by an equation:

$$Vcl = Vclo - \frac{R3}{R4} \cdot \frac{R2}{R1}(Vout - Vo)$$

where Vc1 is said variable threshold level provided at said output node, Vc1*o* is said fixed threshold level, R1 is a resistance value of said first resistor, R2 is a resistance value of said second resistor, R3 is a resistance value of said third resistor, R4 is a resistance value of said fourth resistor, Vout is said output voltage, and Vo is said first fixed voltage level.

13. An electronic system comprising:

a variable output DC power source to provide power to a load; and power control circuitry to provide a control signal to said variable output DC power source, said variable output DC power source responsive to said control signal to adjust an output power level of said DC power source, said power control circuitry comprising:

a first comparator to compare a signal representative of an output current level of said variable output DC power source with a threshold level and provide a first output signal in response to said comparison;

threshold input circuitry to provide said threshold level to said first comparator, said threshold level being a fixed threshold level if an output voltage of said variable output DC power source is less than or equal to a first fixed voltage level, said threshold level being a variable threshold level if said output voltage is greater than said first fixed voltage level; and power limiting control circuitry to provide a control signal to said variable output DC power source in response to said first output signal from said first comparator.

14. The electronic system of claim 13, wherein said variable threshold is representative of a second plurality of output current levels of said variable output DC power source over said first range, said second plurality of output current levels approximates a first plurality of output current levels where each one of said first plurality of output current levels equals a maximum output power level of said variable output DC power source divided by an output voltage of said variable output DC power source over said first range.

15. The electronic system of claim 14, wherein said first plurality of output current levels hyperbolically decreases with increasing voltage levels over said first range and wherein said second plurality of output current levels linearly decreases with increasing voltage levels over said first range.

16. The electronic system of claim 13, wherein said threshold input circuitry comprises:

a first transistor controlled by an output of a first operational amplifier, said first transistor turning OFF is said output voltage is less than said first fixed voltage level, said threshold level being said fixed threshold level if said first transistor is OFF.

17. The electronic system of claim 16, said first transistor turning ON if said output voltage is greater than said first fixed voltage level, said threshold level being said variable threshold level if said first transistor is ON.

18. The electronic system of claim 17, wherein said variable threshold is equal to said fixed threshold less an amount dependent on a difference by which said output voltage exceeds said first fixed voltage level.

19. The electronic system of claim 17, wherein said threshold input circuitry further comprises:

a first resistor disposed between a terminal accepting said output voltage and a terminal of said first transistor;

a second resistor coupled to another terminal of said first transistor;

a second operational amplifier having one input coupled to said another terminal of said first transistor;

a second transistor having a control terminal to accept a signal from said second operational amplifier;

a third resistor disposed between a terminal accepting said fixed threshold level and a terminal of said second transistor, an output node coupled between said third resistor and said terminal of said second transistor;

a fourth resistor coupled to another terminal of said second transistor, wherein said variable threshold level is given by an equation:

$$Vcl = Vclo - \frac{R3}{R4} \cdot \frac{R2}{R1}(Vout - Vo)$$

where Vc1 is said variable threshold level provided at said output node, Vc1*o* is said fixed threshold level, R1 is a resistance value of said first resistor, R2 is a resistance value of said second resistor, R3 is a resistance value of said third resistor, R4 is a resistance value of said fourth resistor, Vout is said output voltage, and Vo is said first fixed voltage level.

* * * * *